US007703443B2

(12) United States Patent
Osawa

(10) Patent No.: US 7,703,443 B2
(45) Date of Patent: Apr. 27, 2010

(54) FUEL SUPPLY DEVICES

(75) Inventor: Yoshikazu Osawa, Obu (JP)

(73) Assignee: Aisan Kogyo Kabuhsiki Kaisha, Obu-shi, Aichi-ken (JP)

( * ) Notice: Subject to any disclaimer, the term of this patent is extended or adjusted under 35 U.S.C. 154(b) by 98 days.

(21) Appl. No.: 12/212,910

(22) Filed: Sep. 18, 2008

(65) Prior Publication Data

US 2009/0101117 A1 Apr. 23, 2009

(30) Foreign Application Priority Data

Oct. 19, 2007 (JP) ..... 2007-272374

(51) Int. Cl.
*F02M 37/04* (2006.01)
*F02M 37/08* (2006.01)

(52) U.S. Cl. ..... 123/509; 123/514

(58) Field of Classification Search ..... 123/509, 123/510, 514; 417/423.3, 360; 137/576, 137/574, 572
See application file for complete search history.

(56) References Cited

U.S. PATENT DOCUMENTS 5,875,816 A * 3/1999 Frank et al. ..... 137/549
6,854,451 B2 * 2/2005 Ebihara et al. ..... 123/509

FOREIGN PATENT DOCUMENTS

JP 2004138046 5/2004
JP 2005083303 3/2005

* cited by examiner

*Primary Examiner*—Mahmoud Gimie
(74) *Attorney, Agent, or Firm*—Dennison, Schultz & MacDonald

(57) ABSTRACT

The present invention includes a fuel supply device for installation within a fuel tank. The fuel supply device includes a fuel pump, a fuel filter, a reservoir cup or a sub-tank. The fuel pump and the fuel filter are disposed within the reservoir cup, so that the fuel within the reservoir cup is pumped by the fuel pump and is thereafter filtrated by the fuel filter. A first coupling device couples the reservoir cup to the fuel tank. A second coupling device couples the fuel filter to the reservoir cup. A third coupling device couples the fuel pump to the fuel filter, so that the fuel pump can swing about a swing axis. The second coupling device is positioned within a substantially vertical plane including the swing axis.

20 Claims, 5 Drawing Sheets

FUEL SUPPLY DEVICES

This application claims priority to Japanese patent application serial number 2007-272374, the contents of which are incorporated herein by reference.

BACKGROUND OF THE INVENTION

1. Field of the Invention

The present invention relates to fuel supply devices, and in particular to in-tank fuel supply devices installed within fuel tanks for supplying fuel to internal combustion engines.

2. Description of the Related Art

An in-tank fuel supply device generally includes a fuel pump for pumping a fuel from a fuel tank, a fuel filter surrounding the fuel pump and having a filter case with a filter element disposed therein, a reservoir cup (sub-tank) that receives the fuel pump and the fuel filter therein, and a set plate (flange) vertically slidably mounted to the reservoir cup and fixed in position relative to the fuel tank. This type of fuel supply device is disclosed, for example, in Japanese Laid-Open Patent Publication No. 2005-83303. In this publication, a circular adaptor (support member) extends inwardly from the inner circumferential wall of a fuel filter and resiliently supports a fuel pump in a suspending manner. A discharge port of the fuel pump and a fuel inlet port of the fuel filter are connected to each other via a first tube, such as a rubber hose. A fuel outlet port of the fuel filter and a fuel discharge pipe of the set plate are connected to each other via a second tube, such as a rubber hose. The fuel filter has a surplus fuel discharge pipe. The surplus fuel discharge pipe extends from the lower side of the fuel filter and is fixedly mounted to the reservoir cup by press-fitting the surplus fuel discharge pipe into a boss portion of the reservoir cup. A spring is interleaved between the fuel filter and the set plate for biasing the reservoir cup in a direction toward the bottom of the fuel tank via the fuel filter. The set plate has two shafts extending downward from the bottom surface. The two shafts are vertically slidably inserted into corresponding two cylindrical shaft guides disposed at the upper end of the side wall of the reservoir cup. The two shafts have the same diameter, and therefore, the shaft guides have the same inner diameter and the same vertical length. In other words, the distance between the axes of the two shafts is equal to the distance between the axes of the two shaft guides.

Also, Japanese Laid-Open Publication No. 2004-138046 discloses a fuel supply device having the construction that is basically the same as the Publication No. 2005-83303 but is different from this publication in the configurations of the shaft guides. Thus, according to the Publication No. 2004-138046, shaft guides are formed integrally with a reservoir cup and each includes three recesses formed in the inner circumferential surface thereof in order to divide the inner circumferential surface into three segments distributed equally in the circumferential direction. With this arrangement, even in the event that shafts extending from a set plate have inclined relative to and within the corresponding shaft guides, the shafts do not contact the inner circumferential surfaces of the shaft guides at positions of the recesses. Although the outer diameter of the shafts and the inner diameter of the shaft guides are the same with each other, the shaft guides have different vertical lengths.

By the way, the fuel within the reservoir cup is drawn into the fuel pump and is then supplied from the discharge port of the fuel pump to an internal combustion engine under pressure via the first tube, the fuel filter, the second tube and the fuel discharge pipe of the set plate in this order. During the pumping operation of the fuel, the fuel pump may vibrate as it is driven. If vibrations of the fuel pump are seriously transmitted to the fuel filter or the reservoir cup, a loud vibration sound may be produced. Therefore, according to the Publication No. 2005-83303, in order to reduce the vibration sound, a plurality of vibration damping members having both flexibility and slidability are disposed between the fuel pump and the fuel filter. The vibrations of the fuel pump may be absorbed and damped by the vibration damping members, and hence, vibrations that may be transmitted to the fuel filter and the reservoir cup may be reduced.

Vibrations may be transmitted from the reservoir cup to the set plate also via contact portions between the shafts and the shaft guides. The sizes of the shafts and the shaft guides are typically designed such that a small clearance is ensured between each shaft and the corresponding shaft guide. Therefore, if the shafts are assembled such that each shaft is positioned vertically centrally within the corresponding shaft guide, no direct contact may occur between the shafts and the shaft guides. However, practically, the positional relationship between the set plate and the reservoir cup may change or the shafts may incline due to error in the assembling operation, vibrations of a vehicle produced during the running of the vehicle, flexure of the fuel tank by the pressure of the fuel within the fuel tank, etc. In such a case, the shafts may contact the shaft guides to cause transmission of vibrations via the contact portions. In the case of the Publication No. 2004-138046, the shafts and the shaft guides may not contact each other at positions of the recesses formed in the inner circumferential surface of each shaft guide. Therefore, vibrations may not be transmitted when the shafts have inclined in the directions toward the recesses.

With the arrangement of the Publication No. 2005-83303, although transmission of vibrations between the fuel pump and the fuel filter may be reduced, it is not possible to completely prevent transmission of vibrations between these components. In addition, transmission of vibrations from these components, i.e., transmission of vibrations from the fuel filter to the reservoir cup or the set plate, is not taken into account in this publication. Thus, vibrations may be transmitted to and from the fuel pump, the fuel filter, the reservoir cup and the set plate via connecting members or connecting portions (fixing portions) between these components. More specifically, vibrations may be transmitted from the fuel filter to the reservoir cup or the set plate via the second tube connecting between the fuel outlet port of the fuel filter and the fuel discharge pipe of the set plate, the spring interleaved between the fuel filter and the set plate, and the fixing portions between the fuel filter and the reservoir cup. In addition, as noted above, vibrations may be transmitted to the set plate via contact portions between the shafts and the shaft guides. Further, vibrations may be transmitted from the fuel pump to the fuel filter via the adaptor (support member) of the fuel filter that resiliently supports the fuel pump in suspending manner, and via the first tube that connects between the fuel discharge port of the fuel pump and the fuel inlet port of the fuel filter.

Further, with the fuel supply device of the Publication No. 2005-83303, there is no regularity in the positional relationship between connecting members or connecting portions that connect the fuel pump, the fuel filter, the reservoir cup and the set plate to each other. The positional relationship may influence the direction of vibrations of the fuel filter, etc. Therefore, the directions of vibrations or impact forces applied to the connecting members or the connecting portions are not uniform, and hence, the fuel pump, i.e., a source of vibrations, and the fuel filter positioned on the upstream side with respect to the direction of transmission of vibrations are hard to move. As a result, vibrations may be transmitted from the fuel pump to the fuel filter due to incomplete absorption by the vibration damping members and may be transmitted further to the reservoir cup and the set plate. In addition, due to no regularity in the positional relationship between the connecting members or the connecting portions, the connecting members or the connecting portions may rather serve as stays against vibrations. Therefore, the rigidity of the fuel filter with respect to the direction of vibrations may be increased (i.e., the amplitude of vibrations may be reduced), and hence, a possibility may exist that vibrations may be transmitted with increased energy. Also in the arrangement of the Publication No. 2004-138046, there is no regularity in the positional relationship between the connecting members or the connecting portions, and therefore, the arrangement of the Publication No. 2004-138046 involves the same problems as described above.

Further, with the arrangement of the Publication No. 2005-83303, the shafts have the same diameter and the shaft guides also have the same diameter. Therefore, if the positional relationship between the set plate and the reservoir cup has been changed of if the set plate and the reservoir cup have inclined relative to each other, both shafts may contact their respective shaft guides, and therefore, the contact area between the shafts and the shaft guides is large. Hence, transmission of vibrations between the shafts and the shaft guides may increase. In the case of the arrangement of the Publication No. 2004-138046, it is possible to avoid contact between the shafts and the shaft guides in some directions by the recesses formed in the inner circumferential surfaces of the shaft guides. The positions of the recesses in each shaft guide are determined not to oppose to each other in the diametrical direction to enhance the function of avoiding the contact. However, it is not possible to cope with the offset or inclination in directions along which no recess is formed. In this case, the shafts may contact the shaft guides by a large contact area and the transmission of vibrations may increase. Although the shaft guides of the Publication No. 2004-138046 have different vertical lengths from each other, this arrangement of this publication does not serve to reduce the contact area between the shafts, and therefore, transmission of vibrations between these components may not be reduced.

Therefore, there is a need in the art for fuel supply devices that can reduce transmission of vibrations from a fuel pump to a reservoir cup or a set plate.

SUMMARY OF THE INVENTION

One aspect according to the present invention includes a fuel supply device for installation within a fuel tank. The fuel supply device includes a fuel pump, a fuel filter, and a reservoir cup or a sub-tank. The fuel pump and the fuel filter are disposed within the reservoir cup, so that the fuel within the reservoir cup is pumped by the fuel pump and is thereafter filtrated by the fuel filter. A first coupling device couples the reservoir cup to the fuel tank. A second coupling device couples the fuel filter to the reservoir cup. A third coupling device couples the fuel pump to the fuel filter, so that the fuel pump can swing about a swing axis. The second coupling device is positioned within a substantially vertical plane including the swing axis.

DETAILED DESCRIPTION OF THE INVENTION

Figure 1:
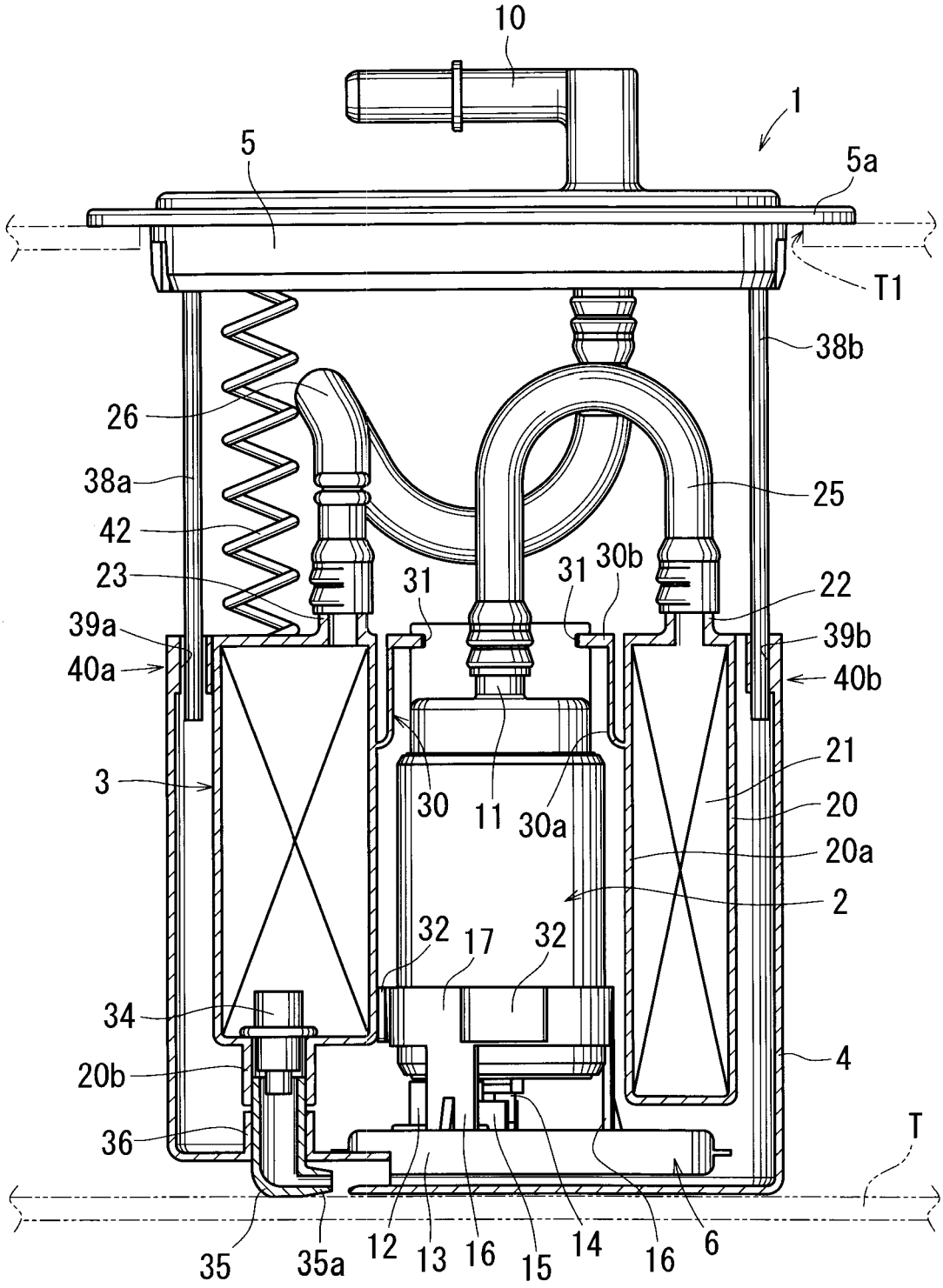
FIG. 1 is a vertical sectional view of a fuel supply device as viewed from a front side according to a first embodiment of the present invention.

Each of the additional features and teachings disclosed above and below may be utilized separately or in conjunction with other features and teachings to provide improved fuel supply devices and fuel supply systems including the fuel supply devices. Representative examples of the present invention, which examples utilize many of these additional features and teachings both separately and in conjunction with one another, will now be described in detail with reference to the attached drawings. This detailed description is merely intended to teach a person of skill in the art further details for practicing preferred aspects of the present teachings and is not intended to limit the scope of the invention. Only the claims define the scope of the claimed invention. Therefore, combinations of features and steps disclosed in the following detailed description may riot be necessary to practice the invention in the broadest sense, and are instead taught merely to particularly describe representative examples of the invention. Moreover, various features of the representative examples and the dependent claims may be combined in ways that are not specifically enumerated in order to provide additional useful embodiments of the present teachings.

In one embodiment, a fuel supply device for installation within a fuel tank includes a fuel pump, a fuel filter, reservoir cup and two support members. The fuel pump serves to pump a fuel. The fuel filter is disposed to surround an outer circumference of the fuel pump. The reservoir cup is disposed within the fuel tank and receives the fuel pump and the fuel filter therein. The two support members extend from an inner circumferential wall of the fuel filter and are positioned to oppose to each other. The support members resiliently support the fuel pump in a suspending manner, so that fuel pump can swing about a swing axis passing through the support members. A coupling device couples the fuel filter and the reservoir cup to each other at a coupling point within a vertical plane including the swing axis.

With this arrangement, because the fuel pump is resiliently supported by the two opposing support members and can swing about the swing axis, the direction of transmission of vibrations from the fuel pump to the fuel filter can be limited. In addition, because the coupling point between the filter case and the reservoir cup is positioned within the same vertical plane as the swing axis, vibrations of the fuel pump may not be directly applied to the coupling point. Therefore, movement about the coupling point of the fuel filter in the same direction as the swinging direction of the fuel pump can be permitted. In addition, the energy of vibrations applied from the fuel pump to the fuel filter may be reduced. Further, because the fuel filter and the reservoir cup are coupled to each other only at one coupling point, the fuel filter can move in the circumferential direction about the coupling point in addition to the same direction as the swinging direction of the fuel pump. Therefore, it is possible to increase the degree of freedom of movement of the fuel filter.

The fuel supply device may further include a plate member and a biasing device. The plate member is fixedly attached to the fuel tank for closing an opening formed in the fuel tank. The biasing device is interleaved between the plate member and the fuel filter for biasing the reservoir cup toward a bottom of the fuel tank. The biasing device is positioned within the vertical plane including the swing axis.

The fuel supply device may further include a first tube connecting between a discharge port of the fuel pump and a fuel inlet port of the fuel filter, a fuel discharge pipe attached to the plate member; and a second tube connecting between a fuel outlet port of the fuel filter and the fuel discharge pipe. The fuel inlet port and the fuel outlet port of the fuel filter are positioned within the vertical plane including the swing axis.

The fuel supply device may further include a slide support device. The slide support device includes a shaft(s) vertically downwardly extending from the plate member, and a shaft guide(s) disposed on the outer circumferential wall of the reservoir cup for receiving the corresponding shaft. The shaft is vertically slidably inserted into the shaft guide, so that the plate member and the reservoir cup are vertically movable relative to each other. The shaft(s) is positioned within the vertical plane including the swing axis.

The fuel supply device may further include a rubber tube that couples the fuel filter and the reservoir cup to each other.

The shafts may include a first shaft and a second shaft, and the shaft guides may include a first shaft guide and a second shaft guide for slidably receiving the first shaft and the second shaft, respectively. The first and second shafts are positioned to be opposed to each other. The first and second shaft guides are positioned to be opposed to each other. The first and second shafts and the first and second shaft guides are configured such that a contact area between the first shaft and the first shaft guide is smaller than a contact area between the second shaft and the second shaft guide when the positional relationship between the plate and the reservoir cup has been changed with respect to a horizontal direction or when the reservoir cup has been inclined relative to the plate.

A clearance between the first shaft and the first shaft guide may be larger than a clearance between the second shaft and the second shaft guide. In addition or alternatively, the first shaft guide may have a vertical length that is smaller than a vertical length of the second shaft guide.

The first shaft may be positioned on the side nearer to the coupling point between the fuel filter and the reservoir cup than the second shaft.

In another embodiment, a fuel supply system includes a fuel tank constructed to store a fuel therein, a reservoir cup disposed within the fuel tank for storing the fuel introduced from within the fuel tank, a fuel pump disposed within the reservoir cup for pumping the fuel stored within the reservoir cup, and a fuel filter disposed within the reservoir cup on an outer circumferential side of the fuel pump for filtering the fuel pumped by the fuel pump. A first coupling device couples the reservoir cup to the fuel tank. A second coupling device couples the fuel filter to the reservoir cup. A third coupling device couples the fuel pump to the fuel filter such that the fuel pump can swing about a substantially horizontal swing axis. The second coupling device is positioned within a substantially vertical plane including the swing axis.

In another embodiment, a fuel supply system includes a fuel tank for storing a fuel therein, a fuel pump disposed within the fuel tank for pumping the fuel stored within the fuel tank, and a support device for supporting the fuel pump within the fuel tank. The support device includes a first support member and a second support member. The first support member supports the fuel pump so that the fuel pump can swing about a first swing axis. The second support member supports the first support member so that the first support member can swing about a second swing axis and can also swing about a third swing axis. The first swing axis and the second swing axis extend substantially in a horizontal direction and are spaced from each other in a vertical direction. The third swing axis extends substantially in the vertical direction and is spaced from a vertical central axis of the fuel pump. The first swing axis, the second swing axis and the third swing axis are positioned substantially within a vertical plane. The central axis of the fuel pump also may be positioned within the same vertical plane.

First Embodiment

Figure 2:
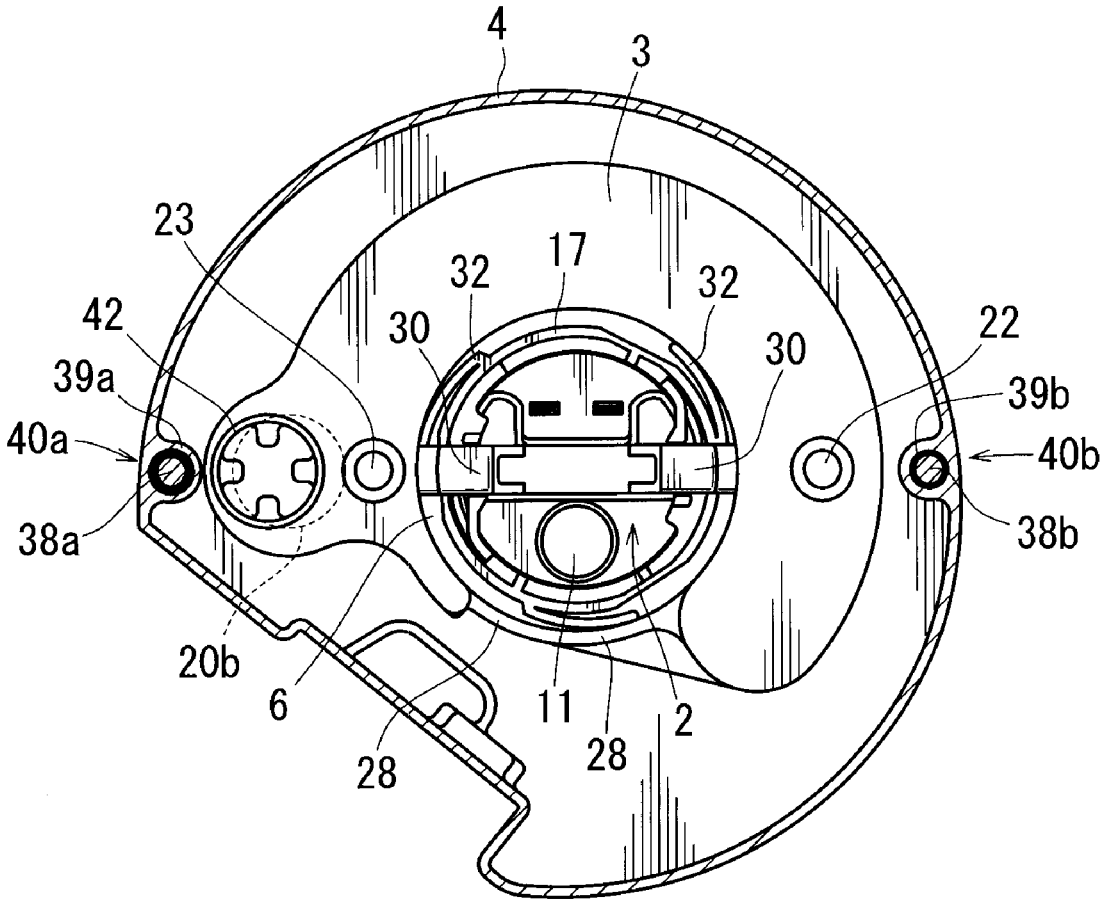
FIG. 2 is a horizontal sectional view of the fuel supply device.

A first embodiment of the present invention will now be described with reference to FIGS. 1 to 5. As shown in FIGS. 1 and 2, a fuel supply device 1 of this embodiment is configured as a module including a fuel pump 2, a fuel filter 3, reservoir cup 4, a set plate 5, etc. The modulated fuel supply device 1 is installed within a fuel tank T (only a part of the fuel tank T is shown in FIG. 1) to constitute a fuel supply system. The fuel tank T is configured as a container defining a fuel storage space that is substantially sealed from the outer side. The fuel tank T has an opening T1 formed in its upper wall. The opening T1 is closed by the set plate 5 attached to the upper wall of the fuel tank T. The reservoir cup 4 has a substantially cylindrical configuration and has an upper open end and a lower closed end. The reservoir cup 4 is placed on the bottom of the fuel tank T. The reservoir cup 4 may be also called as a "sub-tank." The set plate 5 has a flange 5*a* extending radially outward from the outer circumferential edge of the set plate 5. The flange 5*a* is placed on the upper wall of the fuel tank T at a position about the opening T1 and is fixed to the upper wall, so that the set plate 5 closes the opening T1. The set plate 5 may be called simply as a "plate" or a "flange." A fuel discharge pipe 10 is formed integrally with the set plate 5 and extends into and out of the fuel tank T. The fuel discharge pipe 10 is connected to a fuel delivery pipe (not shown) that is disposed externally of the fuel tank T and is connected to an internal combustion engine (not shown).

The fuel pump 2 is an electrically driven pump and has a substantially cylindrical configuration with a central axis extending in a vertical direction. The fuel pump 2 includes a pump section and an electric motor section disposed within a lower portion and an upper portion of the fuel pump 2, respectively. The fuel pump 2 and the fuel filter 3 are disposed within the reservoir cup 4. The fuel pump 2 has a suction port (not shown) and a discharge port 11 that are disposed at the bottom and the top of the fuel pump 2, respectively. A fuel within the reservoir cup 4 can be drawn into the fuel pump 2 via the suction port and can be discharged from the fuel pump 2 via the discharge port 11. A suction filter 9 is attached to the bottom of the fuel pump 2 and includes a mount member 12 fitted into the suction port of the fuel pump 2 and a mesh 13 formed integrally with the mount member 12. The mesh 13 has a horizontally extending flat bag-like configuration. Three upright legs 16 are joined to the upper surface of the mesh 13 and are spaced equally from each other in the circumferential direction. An annular ring 17 is formed integrally with the upper ends of the legs 16, so that the legs 16 are connected to each other via the ring 17. The suction filter 6 is attached to the fuel pump 2 by fitting the ring 17 onto the outer circumference of the fuel pump 2. The fuel pump 2 has a projection 14 extending downward from the central portion of the bottom of the fuel pump 2. The projection 14 is inserted into and supported by a boss portion 15 joined to the upper surface of the mesh 13.

The fuel filter 3 has a substantially C-shaped configuration in plan view and surrounds the outer circumference of the fuel pump 2. A filter element 21 is received within the fuel filter 3. The fuel filter 3 has a fuel inlet port 22 and a fuel discharge port 23. The fuel inlet port 22 is connected to the discharge port 11 of the fuel pump 2 via a first rubber hose 25. The fuel outlet port 23 is connected to the fuel discharge pipe 10 of the set plate 5 via a second rubber hose 26. Because the fuel filter 3 is positioned on the high-pressure side in comparison with the suction filter 6, the fuel filter 3 may be called as a "high-pressure filter." As best shown in FIG. 2, the fuel filter 3 includes a substantially cylindrical tubular portion 28 formed as a one-piece member. The tubular portion 28 has an inner circumferential wall 20*a* that surrounds the fuel pump 2 and is spaced from the outer circumference of the fuel pump 2 by a predetermined gap. The tubular portion 28 is positioned to be coaxial with the annular ring 17 that is joined to the mesh 13.

The fuel filter 3 supports the fuel pump 2 in a suspending manner via a snap-fit device. The snap-fit device includes two support members 30 formed integrally with the inner circumferential wall 20*a* of the fuel filter 3 and extending radially inwardly therefrom. The support members 30 are positioned to oppose to each other in the diametrical direction with respect to the central axis of the fuel pump 2. More specifically, each of the support members 30 includes a resilient portion 30*a* and a joint portion 30*b*. The resilient portion 30*a* is resiliently deformable and extends upward from the inner circumferential wall 20*a* of the fuel filter 3. The joint portion 30*b* extends substantially horizontally inwardly from the upper end of the resilient portion 30*a*. The joint portions 30*b* of the support members 30 are fitted into a groove 31 in a snap-fit manner. The groove 31 is formed in the upper portion of the outer circumferential surface of the fuel pump 2. In this way, the fuel filter 3 resiliently supports the fuel pump 2 in a suspending manner. In addition, the mesh 13 of the suction filter 6 may be positioned not to closely contact with the bottom of the reservoir cup 4. A plurality of vibration damping members 32 are formed integrally with the outer circumferential surface of the annular ring 17 and are spaced equally from each other in the circumferential direction. In this embodiment, three vibration damping members 32 are provided. Each of the vibration damping members 32 has a band-like configuration with a predetermined width in a vertical direction and extends from the annular ring 17 in a cantilever manner, so that each of the vibration damping members 32 is resiliently deformable. The free end of each vibration damping member 32 resiliently contacts the inner circumferential surface of the tubular portion 28 of the fuel filter 3.

The fuel supply device 1 further includes a surplus fuel discharge pipe 35 for the flow of the surplus fuel returning from a pressure regulator 34. A nozzle 35*a* is provided at one end of the surplus fuel discharge pipe 35, so that the nozzle 35*a* serves as a jet pump for pumping the fuel within the fuel tank T into the reservoir cup 4 by using the flow of the surplus fuel. The surplus fuel discharge pipe 35 is press-fitted into a tubular boss portion 36 formed integrally with the bottom wall of the reservoir cup 4 and opening into and out of the reservoir cup 4, so that the surplus fuel discharge pipe 35 is fixed in position relative to the reservoir cup 4. The upper end of the surplus fuel discharge pipe 35 extends upward beyond the upper end of the tubular boss portion 36. A tubular press-fitting portion 20*b* is formed integrally with the bottom wall of the filter case 20 of the fuel filter 3 and is open into and out of the filter case 20. The tubular press-fitting portion 20*b* is press-fitted with the upper end of the surplus fuel discharge pipe 35, so that the fuel filter 3 and the reservoir cup 4 are coupled to each other.

Each of upper ends of two cylindrical shafts 38*a* and 38*b* is threadably engaged with the outer peripheral edge of the set plate 5, so that the shafts 38*a* and 38*b* extend vertically downward from the set plate 5. The shafts 38*a* and 38*b* are positioned on the right side and the left side as viewed in FIG. 1, respectively, and are opposed to each other in the diametrical direction of the fuel pump 2. Two shaft guides 40*a* and 40*b* have vertically extending through-holes 39*a* and 39*b*, respectively, and are formed integrally with the upper end of the outer circumferential wall of the reservoir cup 4 at right and left positions as viewed in FIG. 1. The left shaft 38*a* is slidably inserted into the through-hole 39*a*, and the right shaft 38*b* is slidably inserted into the through-hole 39*b*. Therefore, the set plate 5 and the reservoir cup 4 are coupled to each other via the shaft guides 40*a* and 40*b* such that they can move vertically relative to each other. In this embodiment, the shaft guide 40*a* is positioned nearer to the surplus fuel discharge pipe 35 (more specifically, the press-fitting portion 20*b* of the fuel filter 3) than the shaft guide 40*b*. As noted above, the surplus fuel discharge pipe 35 serves to connect the fuel filter 33 and the reservoir cup 4 to each other. The size of the through-hole 39*a* of the shaft guide 40*a* is determined such that the clearance between the shaft 38*a* and the inner wall of the through-hole 39*a* is larger than the clearance between the shaft 38*b* and the inner wall of the through-hole 39*b* of the shaft guide 40*b*. More specifically, the inner diameter of the through-hole 39*a* of the shaft guide 40*a* is larger than the inner diameter of the through-hole 39*b* of the shaft guide 40*b* (see FIG. 5), while the outer diameter of the shaft 38*a* is equal to the outer diameter of the shaft 38*b*. In this embodiment, the outer diameter of the shafts 38*a* and 38*b* is set to be 5.0 mm, the inner diameter of the through hole 39*a* is set to be 6.0 mm, and the inner diameter of the through hole 39*b* is set to be 5.2 mm.

A compression coil spring 42 is interleaved between the fuel filter 3 and the set plate 5 in order to bias the reservoir cup 4 toward the bottom of the fuel tank T. More specifically, one end of the spring 42 is fitted into a spring receiving recess (not shown) formed in the upper surface of the fuel filter 3, and the other end of the spring 42 is fitted with a projection (not shown) formed integrally with the lower surface of the set plate 5. With the biasing force of the spring 42, the reservoir cup 4 is biased downward via the fuel filter 3.

With the fuel supply device 1 configured as described above, as the fuel pump 2 is driven, the fuel within the reservoir cup 4 disposed within the fuel tank T is drawn into the fuel pump 2 via the suction port of the fuel pump 2 after filtration by the suction filter 6. The fuel drawn into the fuel pump 2 is discharged from the fuel pump 2 via the discharge port 11 and is then fed into the fuel filter 3 via the first rubber hose 25 and the fuel inlet port 22 of the fuel filter 3. The fuel is filtrated further by passing though the fuel filter 3, discharged from the fuel filter 3 via the fuel outlet port 23, fed into the fuel discharge pipe 10 of the set plate 5 via the second rubber hose 26, and eventually supplied to the engine via the fuel delivery pipe. On the other hand, due to the jet pump function by the flow of the surplus fuel flowing out of the nozzle 35*a* of the surplus fuel discharge pipe 35 connected to the pressure regulator 34, the fuel within the fuel tank T is introduced into the reservoir cup 4.

Figure 3:
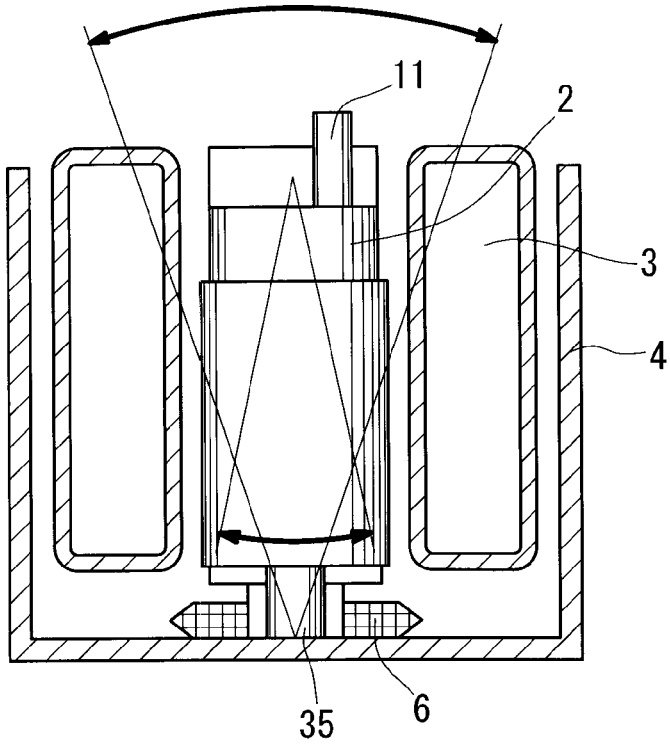
FIG. 3 is a schematic vertical sectional view of the fuel supply device as viewed from a lateral side and showing a swing mechanism.
Figure 4:
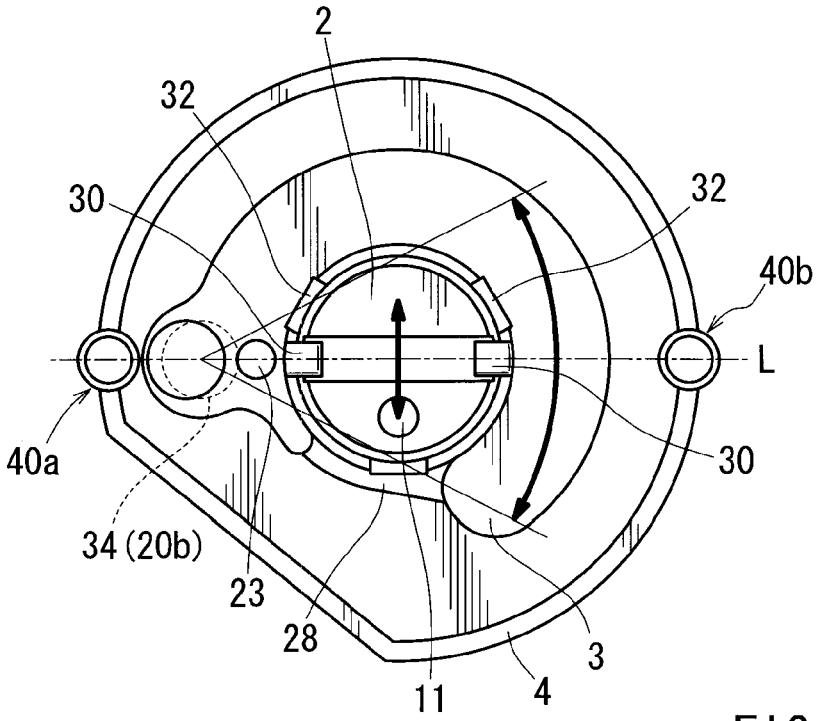
FIG. 4 is a schematic horizontal sectional view of the fuel supply device and showing the swing mechanism.

A swing mechanism of the fuel supply device 1 will now be described with reference to FIGS. 3 and 4. The fuel pump 2 may produce vibrations as it is driven. As the fuel pump 2 vibrates, the fuel pump 2 may prone to swing in a manner like a pendulum about a swing axis L that passes through two support members 30. The vibrations of the fuel pump 2 are transmitted to the fuel filter 3 after being damped or lowered to a certain level by the vibration damping members 32. Therefore, the fuel filter 3 may move or vibrate by vibrations transmitted from the fuel pump 2. Because the press-fitting portion 20*b* of the fuel filter 3 fitting with the reservoir cup 4 is positioned within a vertical plane including the swing axis L, the fuel filter 3 may swing also in a manner like a pendulum about the press-fitting portion 20*b* in the same direction as the swinging direction of the fuel pump 2. The swinging movement of the fuel filter 3 may be inhibited depending on the relative position between the first and second hoses 25 and 26, the spring 42, the reservoir cup 4 and the set plate 5. However, in this embodiment, all the connecting points of these components are positioned within the vertical plane including the swing axis L. Thus, all of the fuel inlet port 22 and the fuel outlet port 23 of the fuel filter 3, the spring 42, and the left and right shaft guides 40*a* and 40*b* that receive the shafts 38*a* and 38*b*, respectively, are positioned within the vertical plane including the swing axis L. Therefore, the swinging movement of the fuel filter 3 may not be substantially inhibited by the above components. In other words, the rigidity of the structure for supporting the fuel filter 3 is low in the swing direction and the fuel filter 3 tends to swing in the swinging direction about the press-fitting portion 20*b*. In addition, the discharge port 11 of the fuel pump 2 and the fuel discharge pipe 10 of the set plate 5 are positioned proximal to the vertical plane including the swing axis L, and therefore, the first and second hoses 25 and 26 extend substantially parallel to the swing axis L. Further, the fuel filter 3 is coupled to the reservoir cup 4 at only one point, i.e., at the press-fitting portion 20*b*, and therefore, the fuel filter 3 can swing also in the circumferential direction about the press-fitting portion 20*b* as indicated by an arrow in FIG. 4. Hence, practically, the fuel filter 3 can swing to make a precession movement as viewed from below. Because the fuel filter 3 can swing without substantial resistance, the energy of vibrations transmitted to the fuel filter 3 can be consumed, and therefore, no substantial vibration may be transmitted further from the fuel filter 3. More specifically, no substantial vibration may be transmitted from the fuel filter 3 to the reservoir cup 4 and the set plate 5. As a result, it is possible to reduce noises that may be produced by the fuel supply device 1.

The vibrations may be transmitted from the reservoir cup 4 to the set plate 5 due to contact between the shafts 38*a* and 38*b* and the corresponding shaft guides 40*a* and 40*b*. However, in this embodiment, the shaft guides 40*a* and 40*b* are positioned at substantially the same level as the swing axis L. Therefore, the swinging movement of the fuel filter 3 may cause no substantial contact between the shafts 38*a* and 38*b* and the corresponding shaft guides 40*a* and 40*b*.

However, the shafts 38*a* and 38*b* and the shaft guides 40*a* and 40*b* may be brought to contact with each other due to the other factors than vibrations of the fuel pump 2. Such other factors may include potential error in assembling the reservoir cup 4, potential vibrations of a vehicle (having the fuel supply device) during the running of the vehicle, and potential flexure of the fuel tank T due to the pressure of the fuel within the fuel tank T. Due to these factors, the positional relationship between the reservoir cup 4 and the set plate 5 may be changed in the horizontal direction or the shafts 38*a* and 38*b* may be inclined to cause contact between the shafts 38*a* and 38*b* and the corresponding shaft guides 40*a* and 40*b*. Actually, the shafts 38*a* and 38*b* and the corresponding shaft guides 40*a* and 40*b* may contact with each other due to the above factors rather than vibrations of the fuel pump 2.

Figure 5A:
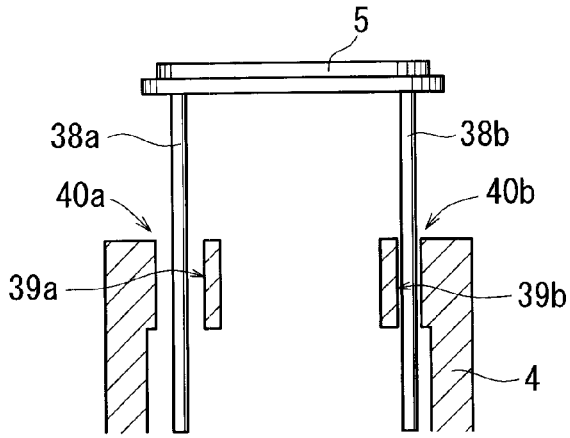
FIGS. 5(A) to 5(C) are views showing the positional relationship between shafts of a set plate and shaft guides of a reservoir cup of the fuel supply device and exaggeratingly showing clearances between the shafts and set plate.
Figure 5B:
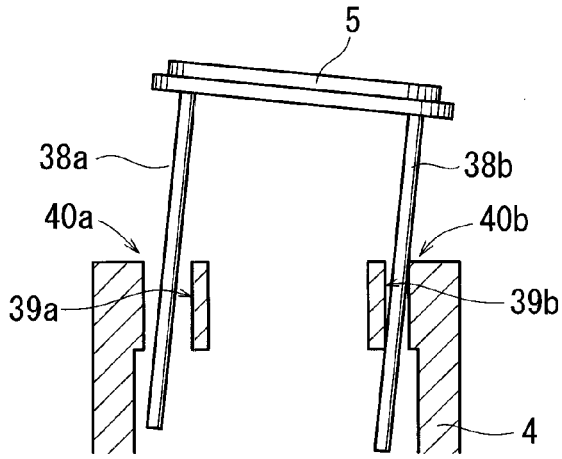
Figure 5C:
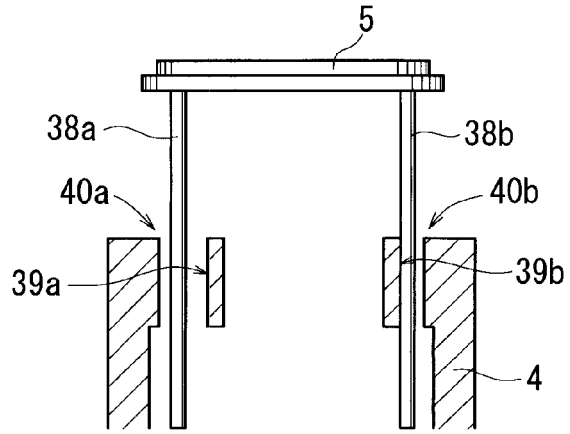

However, according to this embodiment, as noted previously, the size of the through-hole 39*a* of the shaft guide 40*a* is determined such that the clearance between the shaft 38*a* and the inner wall of the through-hole 39*a* is larger than the clearance between the shaft 38*b* and the inner wall of the through-hole 39*b* of the shaft guide 40*b* (see FIG. 5(A). The shaft guide 40*a* is positioned nearer to the surplus fuel discharge pipe 35 (more specifically, the press-fitting portion 20*b* of the fuel filter 3) than the shaft guide 40*b*. Therefore, it is possible to reduce transmission of vibrations from the reservoir cup 4 to the set plate 5. Thus, as shown in FIG. 5(B), in the case that the shafts 38*a* and 38*b* have been inclined due to vibrations of the running vehicle, the flexure of the fuel tank T, etc., the shaft 38*a* may not contact the shaft guide 40*a* although the shaft 38*b* may contact the shaft guide 40*b*. This is because the diameter of the through-hole 39*a* is larger than the diameter of the through-hole 39*b*. In addition, as shown in FIG. 5(C), in the case that the positional relationship between the reservoir cup 4 and the set plate 5 has been changed in the horizontal direction due to vibrations of the running vehicle, the assembling error, etc., the shaft 38*a* may not contact the shaft guide 40*a* having the large diameter through-hole 39*a* for the same reason as described above. Hence, the contact area between the shafts 38*a* and 38*b* and the shaft guides 40*a* and 40*b* can be reduced to be half the contact area that may be resulted in the known fuel supply device. As a result, transmission of vibrations from the reservoir cup 4 to the set plate 5 can be reduced.

Further, even in the even that the shafts 38*a* and 38*b* have been inclined by a large angle due to the application of a large load, it is only possible that the shaft 38*a* contacts the shaft guide 40*a* at one of the upper and lower ends of the through-hole 39*a*. Thus, the contact area of the shaft 38*a* may be smaller than the contact area of the shaft 38*b* that may contact the shaft guide 40*b* at both of the upper and lower ends of the through-hole 39*b*.

As long as the above relationship can be achieved, the clearance between the shaft 38*a* and the shaft guide 40*a* may be of any other sizes than those noted above and may be suitably determined depending on the vertical length of the through hole 39*a* and a maximum inclination angle of the shaft 38*a*. Preferably, the clearance between the shaft 38*a* and the shaft guide 40*a* may be determined to be twice or more than twice of the clearance between the shaft 38*b* and the shaft guide 40*b*.

Second Embodiment

Figure 6:
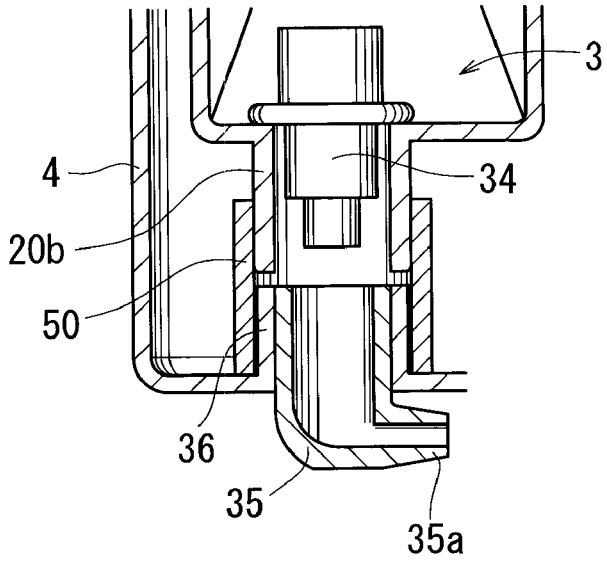
FIG. 6 is an enlarged sectional view of a part of a fuel supply device according to a second embodiment of the present invention.

A second embodiment will now be described with reference to FIG. 6. This embodiment is a modification of the coupling structure between the fuel filter 3 and the reservoir cup 4. The construction other than the coupling structure is the same as the first embodiment. Therefore, the description will be made only to the coupling structure. In FIG. 6, the same elements as the first embodiment are labeled with the same reference numerals, and the description of these elements will not be repeated. As shown in FIG. 6, the surplus fuel discharge pipe 35 is fitted into the boss portion 36 formed integrally with the bottom of the fuel filter 3 such that the upper end of the surplus fuel discharge pipe 35 is positioned at the same level as the upper end of the boss portion 36. A rubber tube 50 is fitted onto the press-fitting portion 20*b* and the boss portion 36 in order to couple these portions 20*b* and 36 to each other. With this coupling structure, the rubber tube 50 can resiliently deform to facilitate the swinging movement of the fuel filter 3, so that the fuel filter 3 can swing easier than in the arrangement of the first embodiment. Therefore, the consumption of the vibration energy at the coupling structure is increased, and the transmission of vibrations from the fuel filter 3 to the reservoir cup 4 and the set plate 5 can be further reduced.

Third Embodiment

Figure 7:
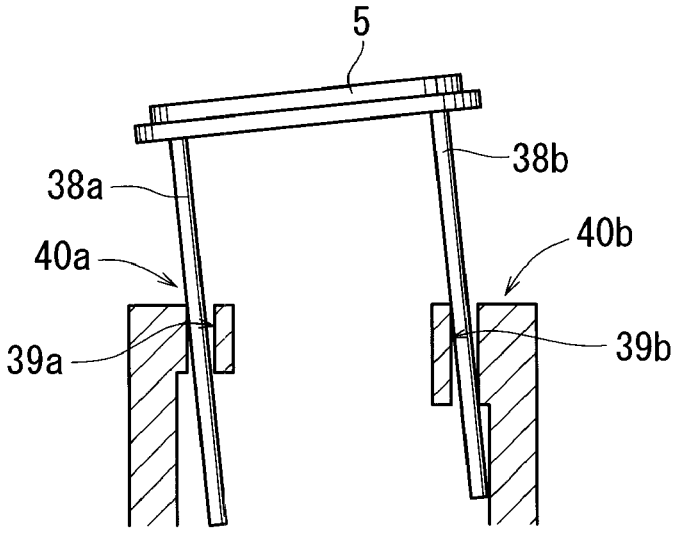
FIG. 7 is a view showing the positional relationship between shafts of a set plate and shaft guides of a reservoir cup of a fuel supply device according to a third embodiment of the present invention.

A third embodiment of the present invention will now be described with reference to FIG. 7. This embodiment is a modification of the shaft guides 40*a* and 40*b*. The construction other than the shaft guides 40*a* and 40*b* is the same as the first or second embodiment. Therefore, the description will be made only to the construction relating to the shaft guides 40*a* and 40*b*. In FIG. 7, the same elements as the first embodiment are labeled with the same reference numerals, and the description of these elements will not be repeated. According to the third embodiment, the vertical length of the shaft guide 40*a* (i.e., the length of the through-hole 39*a*) is set to be shorter than the vertical length of the shaft guide 4 (i.e., the vertical length of the through-hole 39*b*), while the shafts 38*a* and 38*b* have the same outer diameter and the through-holes 39*a* and 39*b* have the same inner diameter. Also with this arrangement, it is possible to make the contact area between the shaft 38*a* and the shaft guide 40*a* (positioned nearer to the surplus fuel discharge pipe 35) smaller than the contact area between the shaft 38*b* and the shaft guide 40*b* when the reservoir cup 4 and the set plate 5 have moved relative to each other in the horizontal direction or have inclined relative to each other. More specifically, the vertical length of the shaft guide 40*a* (i.e., the length of the through-hole 39*a*) is set to be substantially half the vertical length of the shaft guide 40*b* (i.e., the length of the through-hole 39*b*). With this arrangement, when the shafts 38*a* and 38*b* have been inclined due to potential vibrations of the running vehicle or potential flexure of the fuel tank T, the shaft 38*a* may not contact the shaft guide 40*a* even if the shaft 38*b* has contacted the shaft guide 40*b*. This is because the vertical length of the shaft guide 40*a* (i.e., the length of the through-hole 39*a*) is shorter than the vertical length of the shaft guide 40*b* (i.e., the length of the through-hole 39*b*).

As long as the shaft 38*a* does not contact the shaft guide 40*a* or the shaft 38*a* does not contact the shaft guide 40*a* at least at one of the upper or lower ends of the through-hole 39*a*, there is no limitation as to how long the shaft guide 40*a* is shortened in comparison with the length of the shaft guide 40*b*. The length of the shaft guide 40*a* may be suitably determined depending on a possible maximum inclination angle of the shaft 38*a* or any other factors. For example, if the clearance between the shaft 38*b* and the inner wall of the through-hole 39*b* is set to be larger than the clearance between the shaft 38*a* and the inner wall of the through-hole 39*a* of the shaft guide 40*b*, the possible maximum inclination angle of the shaft 38*a* may be large. In such a case, the difference between the vertical length of the shaft guide 40*a* and the vertical length of the shaft guide 40*b* may preferably be increased. For example, the vertical length of the shaft guide 40*a* may be set to be less than half the vertical length of the shaft guide 40*b*. On the contrary, if the clearance between the shaft 38*b* and the inner wall of the through-hole 39*b* is set to be smaller than the clearance between the shaft 38*a* and the inner wall of the through-hole 39*a* of the shaft guide 40*b*, the possible maximum inclination angle of the shaft 38*a* may be small. Therefore, in such a case, the difference between the vertical length of the shaft guide 40*a* and the vertical length of the shaft guide 40*b* may preferably be reduced. For example, the vertical length of the shaft guide 40*a* may be set to be about 60 to 80% of the vertical length of the shaft guide 40*b*.

Other Possible Embodiments

The first and second rubber hoses 25 and 26 may be replaced with any other flexible pipes, such as metal bellows pipes and resin pipes. Although all of the press-fitting portion 20*b*, the fuel inlet port 22 and the fuel outlet port 23 of the fuel filter 3, the spring 42 and the shaft guides 40*a* and 40*b* are positioned within the vertical plane passing through the swing axis L in the above embodiments, it may be possible that only the press-fitting portion 20*b* is positioned within the vertical plane and the other elements are not positioned within the vertical plane, because the position of the press-fitting portion 20*b* determines the direction of the swinging movement of the fuel filter 3. The effect of preventing vibration of the fuel filter 3 may increase in the order of the spring 42 applying the biasing force, the first and second rubber hoses 25 and 26, and the shaft guides 40*a* and 40*b*. Therefore, the necessity of positioning within the vertical plane passing through the swing axis L may increase in this order. Therefore, the positions of these elements may be suitably determined by taking into account of the necessity of their positioning within the vertical plane depending on the maximum amplitude of vibrations (energy level of vibrations), etc.

In order to provide the difference between the clearance between the shaft 38*b* and the inner wall of the through-hole 39*b* of the shaft guide 40*b* and the clearance between the shaft 38*a* and the inner wall of the through-hole 39*a* of the shaft guide 40*a*, it may be possible to set the outer diameter of the shaft 38*a* and the outer diameter of the shaft 38*b* to be different from each other. The arrangement of the first embodiment and the arrangement of the third embodiment may be combined such that (1) the clearance between the shaft 38*b* and the inner wall of the through-hole 39*b* of the shaft guide 40*b* is different from the clearance between the shaft 38*a* and the inner wall of the through-hole 39*a* of the shaft guide 40*a* and (2) the vertical length of the shaft guide 40*b* is different from the vertical length of the shaft guide 40*a*. With this combined arrangement, it is possible to further reduce the potential contact area.

The invention claimed is:

1. A fuel supply device for installation within a fuel tank, comprising:

a fuel pump constructed to pump a fuel;

a fuel filter disposed to surround an outer circumference of the fuel pump;

a reservoir cup disposed within the fuel tank and constructed to receive the fuel pump and the fuel filter therein;

two support members extending from an inner circumferential wall of the fuel filter and positioned to oppose to each other;

wherein the fuel pump is resiliently supported in a suspended manner by the support members, so that the fuel pump can swing about a swing axis passing through the support members; and a coupling device constructed to couple the fuel filter and the reservoir cup to each other at a coupling point within a vertical plane including the swing axis.

2. The fuel supply device as in claim 1, further comprising:

a plate member attached to the fuel tank for closing an opening formed in the fuel tank; and a biasing device interleaved between the plate member and the fuel filter for biasing the reservoir cup toward a bottom of the fuel tank; and wherein the biasing device is positioned within the vertical plane including the swing axis.

3. The fuel supply device as in claim 1, further comprising:

a first tube connecting between a discharge port of the fuel pump and a fuel inlet port of the fuel filter;

a fuel discharge pipe attached to the plate member; and a second tube connecting between a fuel outlet port of the fuel filter and the fuel discharge pipe;

wherein the fuel inlet port and the fuel outlet port of the fuel filter are positioned within the vertical plane including the swing axis.

4. The fuel supply device as in claim 2, further comprising a slide support device including:

at least one shaft vertically downwardly extending from the plate member; and at least one shaft guide each disposed on the outer circumferential wall of the reservoir cup for receiving the shaft; wherein:

the shaft is vertically slidably inserted into the shaft guide, so that the plate member and the reservoir cup are vertically movable relative to each other; and the shaft is positioned within the vertical plane including the swing axis.

5. The fuel supply device as in claim 1, further comprising a rubber tube that couples the fuel filter and the reservoir cup to each other.

6. The fuel supply device as in claim 4, wherein:

the at least one shaft includes a first shaft and a second shaft positioned to be opposed to each other;

the at least one shaft guide includes a first shaft guide and a second shaft guide positioned to be opposed to each other for slidably receiving the first shaft and the second shaft, respectively; and a potential contact area between the first shaft and the first shaft guide is smaller than a potential contact area between the second shaft and the second shaft guide when the positional relationship between the plate and the reservoir cup has been changed with respect to a horizontal direction or when the reservoir cup has been inclined relative to the plate.

7. The fuel supply device as in claim 6, wherein a clearance between the first shaft and the first shaft guide is larger than a clearance between the second shaft and the second shaft guide.

8. The fuel supply device as in claim 6, wherein the first shaft guide has a vertical length that is shorter than a vertical length of the second shaft guide.

9. The fuel supply device as in claim 6, wherein the first shaft is positioned on the side nearer to the coupling point between the fuel filter and the reservoir cup than the second shaft.

10. A fuel supply system comprising:

a fuel tank constructed to store a fuel therein;

a reservoir cup disposed within the fuel tank and constructed to store the fuel introduced from within the fuel tank;

a fuel pump disposed within the reservoir cup and constructed to pump the fuel stored within the reservoir cup;

a fuel filter disposed within the reservoir cup on an outer circumferential side of the fuel pump and constructed to filtrate the fuel pumped by the fuel pump;

a first coupling device constructed to couple the reservoir cup to the fuel tank;

a second coupling device constructed to couple the fuel filter to the reservoir cup; and a third coupling device constructed to couple the fuel pump to the fuel filter; wherein:

the third coupling device couples the fuel pump to the fuel filter such that the fuel pump can swing about a substantially horizontal swing axis;

the second coupling device is positioned within a substantially vertical plane including the swing axis.

11. The fuel supply system as in claim 10, wherein the first coupling device is positioned within the substantially vertical plane including the swing axis.

12. The fuel supply system as in claim 10, wherein the first coupling device is configured to couple the reservoir cup to the fuel tank so that the reservoir cup can move vertically within the fuel tank and can move in a horizontal direction relative to the fuel tank within a predetermined range.

13. The fuel supply system as in claim 12, wherein the first coupling device comprises:

a first shaft and a second shaft fixed in position relative to the fuel tank and extending parallel to each other in a vertical direction;

a first shaft guide and a second shaft guide disposed on the reservoir cup and slidably receiving the first shaft and the second shaft, respectively; wherein:

a first clearance is defined between the first shaft and the first shaft guide; and a second clearance is defined between the second shaft and the second shaft guide.

14. The fuel supply system as in claim 13, wherein the first clearance is larger than the second clearance.

15. The fuel supply system as in claim 13, wherein the first shaft guide has a vertical length shorter than a vertical length of the second shaft guide.

16. The fuel supply system as in claim 10, wherein the second coupling device couples the fuel filter to the reservoir cup at a point offset from a vertical central axis of the fuel pump.

17. The fuel supply system as in claim 16, wherein the fuel filter can swing about a first axis parallel to the swing axis and can also swing about a second axis perpendicular to the first axis and substantially parallel to the vertical central axis of the fuel pump.

18. The fuel supply system as in claim 10, wherein the third coupling device comprises a support damper disposed on the fuel filter and supporting the fuel pump such that the fuel pump can swing about the swing axis.

19. A fuel supply system comprising:

a fuel tank constructed to store a fuel therein;

a fuel pump disposed within the fuel tank and constructed to pump the fuel stored within the fuel tank, the fuel pump having a vertical central axis;

a support device constructed to support the fuel pump within the fuel tank, the support device comprising:

a first support member supporting the fuel pump so that the fuel pump can swing about a first swing axis; and a second support member supporting the first support member so that the first support member can swing about a second swing axis and can also swing about a third swing axis, wherein:

the first swing axis and the second swing axis extend substantially in a horizontal direction and are spaced from each other in a vertical direction;

the third swing axis extends substantially in the vertical direction and is spaced from the central axis of the fuel pump in the horizontal direction;

wherein the central axis of the fuel pump, the first swing axis, the second swing axis and the third swing axis are positioned substantially within a single vertical plane.

20. The fuel supply system as in claim 19, wherein the second support member is vertically movably coupled to the fuel tank at positions substantially within the vertical plane.

* * * * *